US008677901B2

(12) United States Patent
Epstein et al.

(10) Patent No.: US 8,677,901 B2
(45) Date of Patent: Mar. 25, 2014

(54) TAPERED COMPRESSED POWDER CHARGE FOR MUZZLELOADER AND BLACK POWDER FIREARMS

(75) Inventors: Brett Neal Epstein, Wellington, FL (US); Mark Andrew Griesbach, Hortonville, WI (US)

(73) Assignee: American Pioneer Powder, Inc., Whitewater, CO (US)

( * ) Notice: Subject to any disclaimer, the term of this patent is extended or adjusted under 35 U.S.C. 154(b) by 69 days.

(21) Appl. No.: 13/369,449

(22) Filed: Feb. 9, 2012

(65) Prior Publication Data

US 2012/0168974 A1 Jul. 5, 2012

Related U.S. Application Data

(62) Division of application No. 12/363,032, filed on Jan. 30, 2009, now Pat. No. 8,132,511.

(60) Provisional application No. 61/025,460, filed on Feb. 1, 2008, provisional application No. 61/104,456, filed on Oct. 10, 2008.

(51) Int. Cl.
*C06B 21/00* (2006.01)
*C06D 5/00* (2006.01)

(52) U.S. Cl.
USPC ..... 102/288; 102/283; 102/286; 42/51; 264/3.4

(58) Field of Classification Search
USPC ..... 102/283, 285, 286, 287, 288, 291, 292, 102/431; 264/3.1, 3.4; 42/51; 86/1.1
See application file for complete search history.

(56) References Cited

U.S. PATENT DOCUMENTS

| | | | | |
|---|---|---|---|---|
| 3,937,771 | A | 2/1976 | Voigt, Jr. et al. | |
| 4,083,912 | A * | 4/1978 | Platte et al. | 264/120 |
| 5,619,073 | A * | 4/1997 | Posey et al. | 264/3.3 |
| 6,688,232 | B2 | 2/2004 | Griesbach et al. | |
| 6,877,415 | B2 | 4/2005 | Griesbach et al. | |
| 8,132,511 | B2 * | 3/2012 | Epstein et al. | 102/288 |

* cited by examiner

*Primary Examiner* — James Bergin
(74) *Attorney, Agent, or Firm* — Davis & Bujold, PLLC; Michael J. Bujold

(57) ABSTRACT

A method of manufacturing a premeasured compressed charge in which the compressed charge has a leading end portion with a smaller dimension than both a trailing end portion and a desired caliber of the intended firearm and the trailing end portion has a larger diagonal dimension than the desired caliber of the firearm. The method comprises the steps of providing a mold with cavities, filling the mold cavities with gunpowder, pressing gunpowder to form a compressed charge so that one of a density and a compaction of the gunpowder, adjacent the leading end portion of the compressed charge, is about 0% to about 5% less than the density or the compaction of the gunpowder adjacent the trailing end portion to facilitate a more complete combustion of the compressed charge upon discharge of the firearm, and removing the compressed charge from the cavities.

27 Claims, 14 Drawing Sheets

Fig. 15
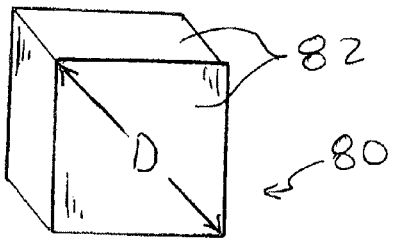
Fig. 16
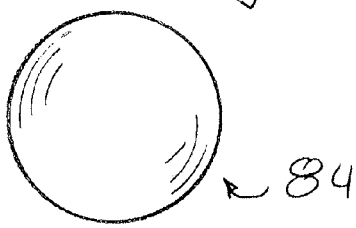
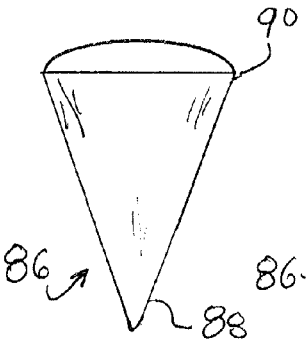
Fig. 17A
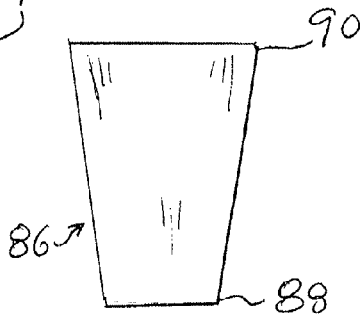
Fig. 17B
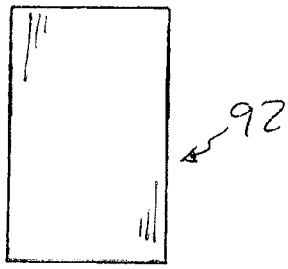
Fig. 18
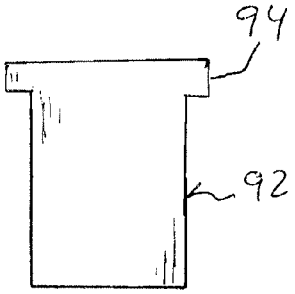
Fig. 19A
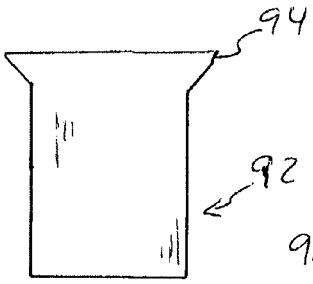
Fig. 19B
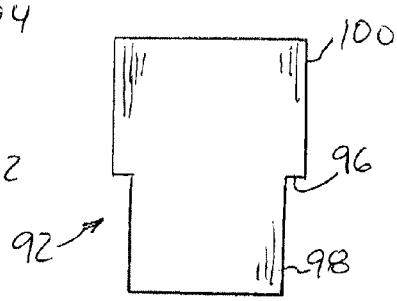
Fig. 20

TAPERED COMPRESSED POWDER CHARGE FOR MUZZLELOADER AND BLACK POWDER FIREARMS

FIELD OF THE INVENTION

The present invention relates to an improved premeasured compressed charge for use in muzzleloading and black powder firearms.

BACKGROUND OF THE INVENTION

An important aspect when using a traditional muzzleloading or black powder firearm is to facilitate quick, reliable and consistent reloading of the firearm following discharge. As is conventionally known in the art, a desired volume of gunpowder propellent is supplied to either the muzzle end or the breech end of the barrel of a gun, depending on the design of the firearm. During loading of a muzzleloading firearm, the charge, the sabot and/or the patch (wad), if necessary, and the projectile, in that order, are all loaded through the discharging end of the barrel—sometimes the sabot and/or patch (wad) may be omitted. The contents are typically packed toward the breech end of the firearm using a ramrod to ensure a consistent loading and seating pressure of the propellant and the projectile and the seating reduces the chances of a potential over pressure situation in the barrel of the firearm because of an air gap forming between the propellant and the projectile.

As is well known in the art, the propellent was typically a loose granular gunpowder, e.g., a mixture of charcoal, potassium nitrate and sulfur. Early powders were dangerous to handle and tended to foul the bore of the firearm. That is, after one or more firings of the firearm, the user would typically have to clean the bore of the barrel using a device which scrapes or wipes the inner bore surface of the barrel. If such cleaning was not periodically performed or performed improperly, the interior bore of the barrel build-ups a layer of residue of unconsumed propellent and such residue can lead to corrosion and/or malfunctioning of the firearm and clogging of the ignition or flash channel. For a number of years, black powder was the only propellent used in muzzleloading firearms, and eventually black powder substitutes, such as those sold under the trade names PYRODEX, BLACK CANYON, CLEAN SHOT and AMERICAN PIONEER, are now commonly utilized. For at least the past 25 years, black powder and black powder substitutes have been pelletized to facilitate ease of loading of firearms.

SUMMARY OF THE INVENTION

Wherefore, it is an object of the present invention to overcome the above mentioned shortcomings and drawbacks associated with the prior art propellent charges used with muzzleloading firearms.

Another object of the present invention is to design a compressed charge which has a substantially square or rectangular transverse cross-section which slightly tapers or expands only along two side surfaces, from a smaller dimension leading portion to a wider dimension trailing portion.

A further object of the present invention is to design a compressed charge which assists with trapping a very small amount of ambient air within the breech end of the barrel, following loading of the barrel with the compressed charge and a slug or bullet (and possibly a sabot and/or the patch (wad)) to be discharged by the firearm, and this trapped air facilitates a more rapid and complete burning of the gunpowder and thereby minimizes the amount of any unburned or unconsumed particles of powder which remain in the barrel, following discharge, thereby minimizing the likelihood that any unburned or unconsumed particles may later cause a malfunction of the firearm, e.g., cause inadvertent ignition when reloading, blockage of the flash channel or restrict loading of a projectile.

Another object of the invention is to provide a compressed charge which facilitates propagation of the flame, generated by the percussion cap or other ignition device, and assists with distributing this propagated flame over the entire leading end wall of the compressed charge as well as along the two tapered and two rectangular sidewalls of the compressed charge to facilitate faster and better ignition of the compressed charge upon discharge of the firearm, i.e., the compressed charge burns axially from the smaller dimension leading end wall or portion toward the wider dimension trailing end wall or portion as well as radially inwardly from each one of the four sidewalls toward a center of the compressed charge.

Yet another object of the present invention is to provide a compressed charge which, upon inserting the compressed charge inside an adequately sized bore of a barrel of a firearm, is designed to cause a small percentage of the charge, e.g., a fraction of one percent to about five percent or so of the large dimension trailing portion, to be removed, scraped or shaved from the compressed charge, by the leading edge or inner surface of the barrel of the firearm, so that the shaved off powder typically falls toward the breech end of the barrel. This shaved gunpowder assists with improving the flame intensity at the outlet of the flash channel, generated by the percussion cap (or other igniting device such as a musket cap, a flint, etc.), and also assists with a more rapid burning of the compressed charge.

Still another object of the present invention is to provide a compressed charge which will be centered and captively received within the breech end of the bore of the firearm, due to the interference fit between the compressed charge and the bore of the barrel, to minimize any lateral movement or shifting of the compressed charge once completely loaded within the barrel.

A further object of the present invention is to taper slightly the leading end portion of the compressed charge along two opposed side walls so that the tapered leading end portion of the compressed charge is located closely adjacent an outlet, of the flash channel, to facilitate a more reliable, quicker and complete ignition of the compressed charge and better flame propagation, e.g., to space the tapered leading end wall slightly closer to the outlet of the flash channel than is generally possible with prior art designs as well as provide a small area to assist with flame propagation.

A still further object of the present invention is ensure complete burning of the propellent charge, following ignition but prior to discharging the projectile out the muzzle end of the firearm, to minimize the possibility of discharging any unburnt particles of the propellent charge out the muzzle end of the firearm, i.e., to avoid "rocketing" of a portion of the compressed charge out the muzzle end of the firearm. The elimination, or minimization at the very least, of any unburnt particles from the breech end of the barrel, in turn, facilitates a shorter time span that the end user must wait before safely reloading the firearm with another compressed charge for a subsequent firing. The elimination or minimization of unburnt particles also leads to better accuracy and consistency when using the firearm.

Yet another object of the present invention is to ensure a quicker and more complete ignition of the propellent charge to facilitate use of the compressed charge in "short barrel" rifles and pistols.

Still another object of the present invention is to taper only two sidewalls of the propellent charge from the smaller dimension leading portion to the wider dimension trailing portion to assist with centering of the charge within the barrel while promoting flame propagation.

A further object of the present invention is to increase the exposed sidewall surface area of the compressed charge to facilitate a more rapid and complete burning of the compressed charge upon discharging the firearm.

Yet another object of the present invention is to provide a method of forming a compressed charge with a reduced formation pressure to thereby result in a compressed charge that has a more uniform density along the entire axial length of the compressed charge and this, in turn, promotes faster and more complete ignition of the compressed charge upon discharge of the firearm.

A further object of the present invention is to provide an improved gunpowder formulation which has an increased amount of potassium perchlorate so that the resulting compressed charge formed from the improved gunpowder has an increased power level (per unit volume) and this results in the manufacture of smaller compressed charges which have a power level equal to or greater than larger size prior art compressed charges and/or multiple compressed charges. A reduction in the size and/or length of the compressed charge also tends to increase the durability of the compressed charge and this reduces the likelihood that the compressed charge will partially break or disintegrate during shipment, handling and/or loading. Additionally, shorter more powerful compressed charges are more convenient and tend to be safer than known compressed charges heretofore produced since only a single compressed charge need be used to obtain the same amount of power as two or more prior art compressed charges. Using multiple compressed charges further typically decreases the uniformity from one shot to the next because allowable size differences, between one compressed charge to the next, can add up to significant differences in shooting power and performance.

The present invention also relates to a method of manufacturing a compressed charge for use with an intended black powder firearm having a desired caliber, the compressed charge having a leading end portion with a smaller dimension than both a trailing end portion and the desired caliber of the intended firearm, and the trailing end portion having a larger diagonal dimension than the desired caliber of the firearm such that the leading end portion of the compressed charge is received within the desired caliber of the firearm while the trailing end portion has an interference fit must be forced into the desired caliber of the firearm, the method comprising the steps of: providing a mold having at least one cavity therein, and each cavity having a pair of opposed side walls which taper toward one another from a trailing end wall of the cavity toward the leading end wall of the cavity and a bottom molding surface of the cavity which extends normal to each of the opposed side walls and the two end walls; filling a cavity of a mold with gunpowder having a sufficient moisture content; pressing the gunpowder contained within the cavity with a top molding surface, which extends parallel to the bottom molding surface, such that the gunpowder within the cavity is sandwiched between the parallel top and bottom molding surfaces and form the compressed charge and, as a result of such pressing, the formed compressed charge only tapers along two surfaces and one of a density and a compaction of the gunpowder, adjacent the leading end portion of the compressed charge, is about 0% to about 5% less than one of the density and the compaction of the gunpowder adjacent the trailing end portion to facilitate a more complete combustion of the compressed charge upon discharge of the firearm; and releasing the compressed charge from the cavity of the mold.

The present invention also relates to an improved compressed charge for use with a black powder firearm having a desired caliber of an intended firearm, the compressed charge having a leading end portion and a trailing end portion, the leading end portion having a smaller dimension than both the trailing end portion and the desired caliber of the intended firearm, while the trailing end portion having a larger diagonal dimension than the desired caliber of the firearm such that the leading end portion of the compressed charge is received within the desired caliber of the firearm while the trailing end portion must be forced into the desired caliber of the firearm; the leading end portion of the compressed charge being located closely adjacent an outlet of the flash channel of the firearm, following loading of the compressed charge within the firearm, and the leading end portion facilitates flame propagation of the flame along sidewalls of the compressed charge; wherein one of a density and a compaction of the gunpowder, adjacent the leading end portion, is about 0% to about 5% less than one of the density and the compaction of the gunpowder adjacent the trailing end portion to facilitate a more complete combustion of the compressed charge upon discharge of the firearm.

In the following description and the appended claims, the term "ignition device" is used to generally refer to one of a percussion cap, a musket cap, a flint, etc., or some other discharging or igniting device for a muzzleloader or a black powder firearm. It should be further noted that this invention can be used with a black powder for modern cartridges that have a primer of an a percussion cap integrated therein. The term "grain", as used herein, is intended to mean velocity equivalent and not weight.

BRIEF DESCRIPTION OF THE DRAWINGS

The invention will now be described, by way of example, with reference to the accompanying drawings in which:

FIG. 15 is a diagrammatic perspective view of a compressed charge having a generally cubic shape;

FIG. 16 is a diagrammatic perspective view of a compressed charge having a generally spherical shape;

FIGS. 17A and 17B are diagrammatic perspective views of compressed charges having a generally conical shape;

FIG. 18 is a diagrammatic perspective view of a compressed charge having a generally cylindrical shape;

FIGS. 19A and 19B are a diagrammatic perspective views of compressed charges having a generally cylindrical shape and being provided with a trailing annular rim; and FIG. 20 is a diagrammatic perspective view of a compressed charge having a generally cylindrical shape with an increase in diameter between the leading end and the trailing end of the compressed charge.

DETAILED DESCRIPTION OF THE INVENTION

Figure 1:
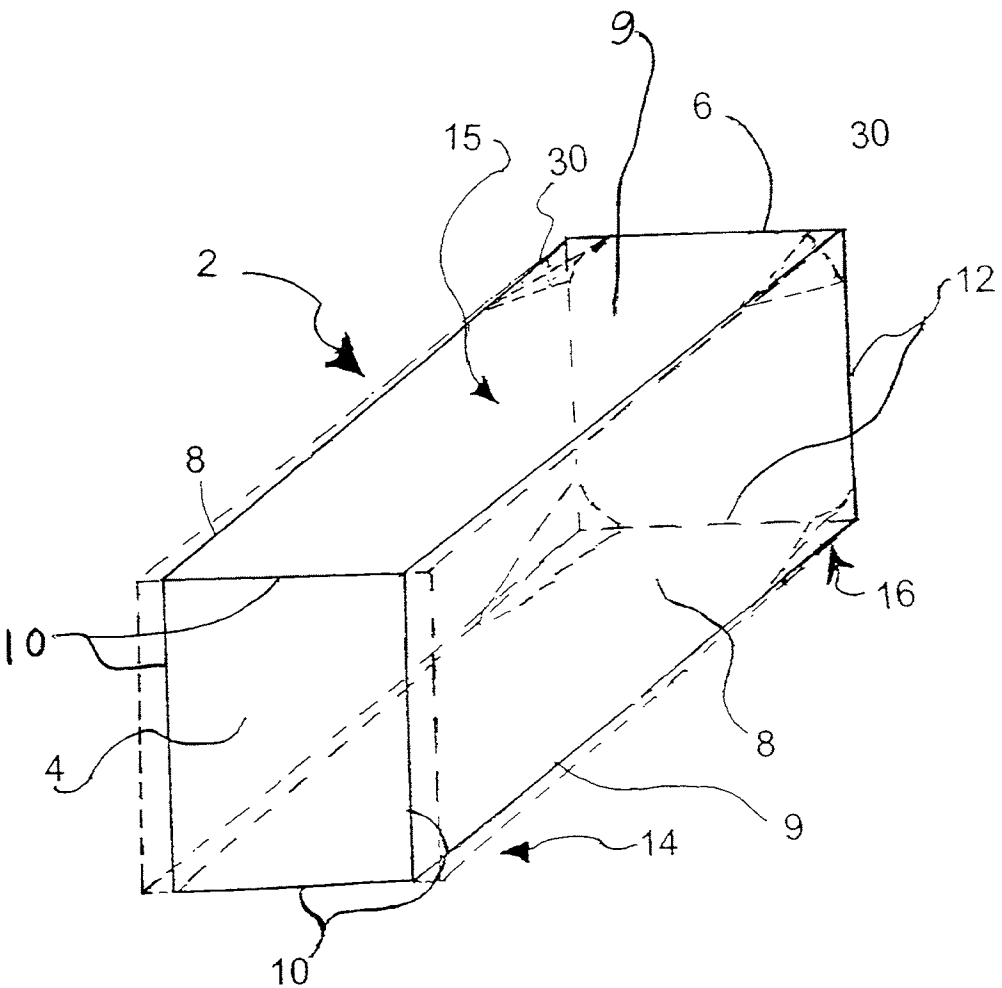
FIG. 1 is a diagrammatic perspective view of a first embodiment of a premeasured compressed charge according to the present invention.
Figure 2:
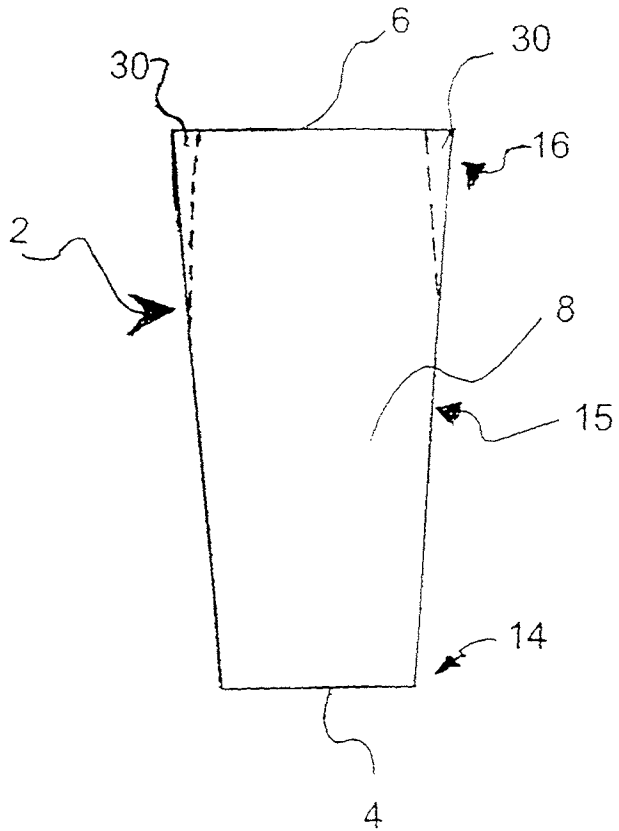
FIG. 2 is a diagrammatic top plan view of the premeasured compressed charge of FIG. 1.
Figure 3:
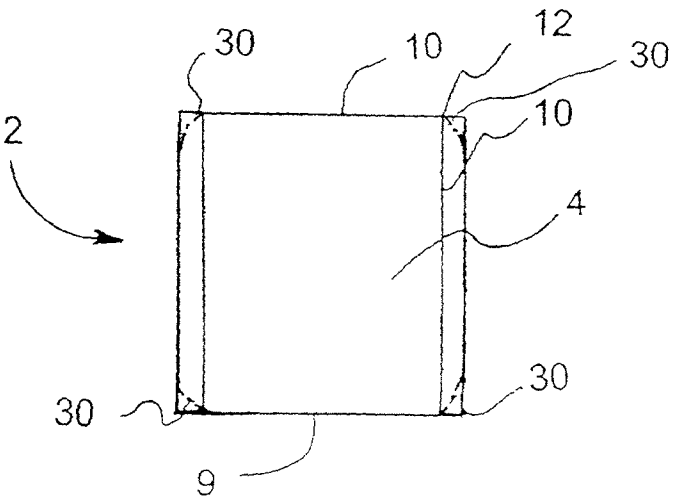
FIG. 3 is a diagrammatic front elevational view of the leading end of the premeasured compressed charge of FIG. 1.

Turning now to FIGS. 1-3, a detailed description concerning the improved compressed charge 2 will now be provided. As can be seen in FIG. 1, the compressed charge 2 comprises a pair of substantially planar end walls 4, 6 which are both generally rectangular or square in shape. The leading end wall 4 has a dimension which is less than the inside diameter of the barrel for which it is designed, e.g., for a 50-caliber barrel the leading end wall 4 has, for example, a diagonal measurement of between 0.400 and 0.501 inches, preferably about 0.491 inches or so, while the trailing end wall 6 has a dimension greater than the inside diameter of the barrel for which it is designed, e.g., the trailing end wall is oversized by between 0.001 and 0.040 inches, preferably oversized by about 0.010 inches, that is, for a 50-caliber barrel the trailing end wall 6 has a diagonal measurement of approximately 0.501 and 0.540 inches, preferably about 0.517 inches.

According to this embodiment, the two opposed substantially planar but slightly tapering sidewalls 8 extend from a perimeter region or edge 10 of the leading end wall 4 to a perimeter region or edge 12 of the trailing end wall 6. That is, the first and third tapering sidewalls 8 each form an acute angle with the trailing end wall 6 and form an obtuse angle with the leading end wall 4. The second and the fourth sidewalls 9 are located directly opposite one another and also are substantially planar sidewalls which extend from a remaining perimeter region or edge 10 of the leading end wall 4 to a remaining perimeter region or edge 12 of the trailing end wall 6. Neither the second nor the fourth substantially planar sidewalls 9 taper with respect to one another. That is, the second and the fourth substantially planar sidewalls 9 both extend or lie normal to both the leading end wall 4 and the trailing end wall 6 and extend parallel to, but are spaced from, one another such that the width dimension of the second and the fourth substantially planar sidewalls 9 is substantially constant from the leading end wall 4 to the trailing end wall 6.

Figure 10A:
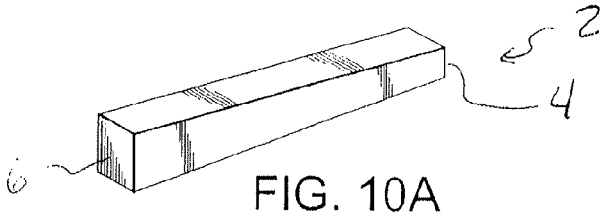
FIG. 10A is a front, bottom, left side diagrammatic perspective view of the first embodiment but for a 200 grain charge.
Figure 10B:
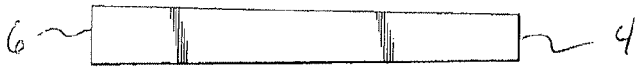
FIG. 10B is a bottom plan view of FIG. 10A
Figure 10C:
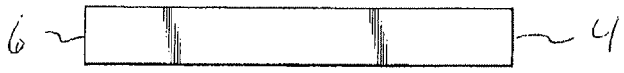
FIG. 10C is a front elevational diagrammatic view of FIG. 10A.
Figure 11A:
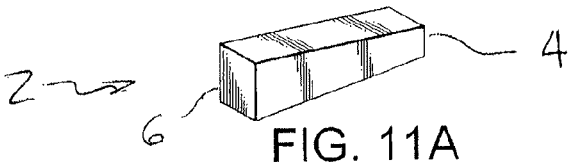
FIG. 11A is a front, bottom, left side diagrammatic perspective view of the first embodiment but for a 100 grain charge.
Figure 11B:
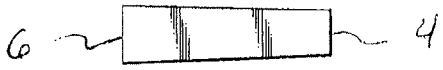
FIG. 11B is a bottom plan view of FIG. 11A
Figure 11C:
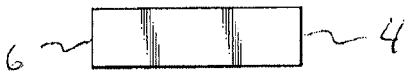
FIG. 11C is a diagrammatic front elevational view of FIG. 11A.
Figure 13A:
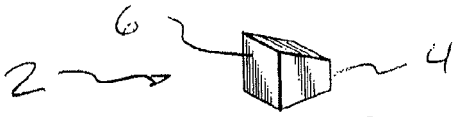
FIG. 13A is a front, bottom, left side diagrammatic perspective view of the first embodiment but for a 30 grain charge.
Figure 13B:
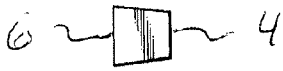
FIG. 13B is a bottom plan view of FIG. 13A
Figure 13C:
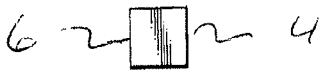
FIG. 13C is a diagrammatic front elevational view of FIG. 13A.
Figure 12A:
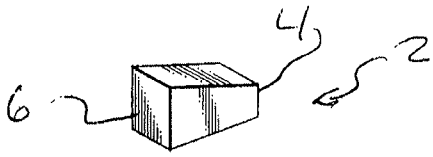
FIG. 12A is a front, bottom, left side diagrammatic perspective view of the first embodiment but for a 50 grain charge.
Figure 12B:
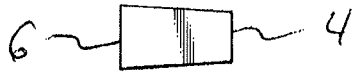
FIG. 12B is a bottom plan view of FIG. 12A
Figure 12C:
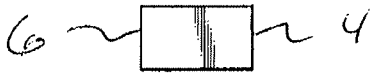
FIG. 12C is a diagrammatic front elevational view of FIG. 12A.

As a result of this configuration, a 200 grain velocity equivalent charge of the compressed charge 2, for a 50-caliber firearm, generally has an axial longitudinal length of between 2.75 inches and 2.55 inches (see FIG. 10B, for example), a 150 grain velocity equivalent charge of the compressed charge 2 generally has an axial longitudinal length of between 1.9 and 2.1 inches (see FIG. 2, for example), a 100 grain velocity equivalent charge of the compressed charge 2 generally has an axial longitudinal length of between 1.60 and 1.25 inches (see FIG. 11B, for example), a 50 grain velocity equivalent charge of the compressed charge 2 generally has an axial longitudinal length of between 0.90 and 0.49 inches (see FIG. 12B, for example) and a 30 grain velocity equivalent charge of the compressed charge 2 generally has an axial longitudinal length of between 0.45 and 0.35 inches (see FIG. 13B, for example).

In short, it is possible to manufacture compressed charges anywhere from about 10 grain velocity equivalent charge or so to about 250 grain velocity equivalent charge or so by weight. Large cartridges of virtually any size (i.e., more than 250 grain velocity equivalent charges) could be produced but a customized shipping container will most likely be required. Accordingly, the axial longitudinal and radial dimensions of the compressed charge 2 can vary from application to application, depending upon a number of factors, e.g., the diameter of the barrel, the size of the projectile to be discharged, the desired exit velocity of the projectile, etc. Typically, the diagonal dimension of the leading end portion is between about 0.400 and about 0.501 inches, preferably about 0.491 inches or so, and the diagonal dimension of the trailing end portion is between about 0.501 and about 0.540 inches, preferably about 0.517 inches.

The compressed charge 2 is generally a solid unitary structure of a chemical mixture of a propellant, possibly black powder. According to the present invention, a black powder substitute is utilized which contains a mixture of potassium perchlorate, potassium nitrate, a fuel component such as an amino acid or a carbohydrate, e.g., ascorbic acid, sugar, starch, etc., and charcoal (carbon). It is to be appreciated that any other black powder substitute, particularly those containing a fuel component from the carbohydrate family (e.g., sugar, starch, etc.) as a partial or complete substitute for the ascorbic acid fuel component, will also function well. Sugar, according to the present invention, is intended to cover, for example, glucose, fructose, dextrose, lactose, simple sugars, etc. Starch, according to the present invention, is intended to cover, for example, rice starch, potato starch, dextrin, etc.

A suitable formula for the compressed charge, according to the present invention, comprises a mixture of: about 10-35% by weight of potassium perchlorate; about 25-60% by weight of potassium nitrate; about 25-50% by weight of a fuel component (such as ascorbic acid or some other carbohydrate family composition(s)); and about 0-5% by weight of hardwood charcoal and/or carbon (lamp) black. To improve the power of the compressed charge 2 and facilitate rapid burning of the compressed charge 2, the percent by weight of potassium perchlorate is increased by a few percent. The inventors have discovered that by slightly increasing the amount of charcoal and/or carbon (lamp) black in the formula, the compressed charge 2 is easier to ignite, more moisture resistant and more dependable from an ignition perspective. Although the above range is preferred for manufacturing the compressed charge 2, it is to be appreciated that other currently available types and/or brands of black powder and/or black powder substitutes may also be used to manufacture the compressed charge 2 without departing from the spirit and scope of the present invention.

Figure 4:
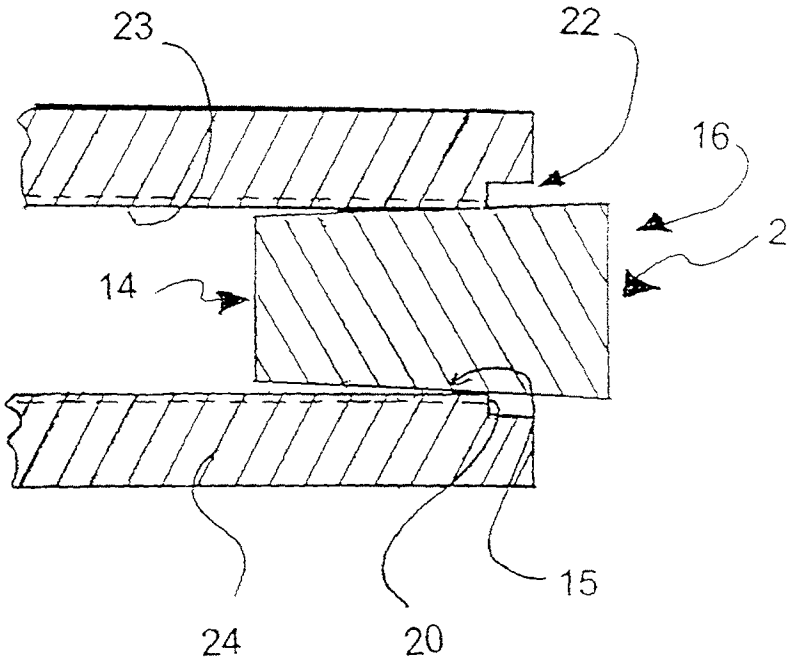
FIG. 4 diagrammatically shows the initially loaded position of the premeasured compressed charge of FIG. 1 in a muzzle end of a gun barrel.

It is to be appreciated that the barrel 24 of a 50-caliber firearm typically has a nominal bore 23 diameter or dimension of about 0.500 of an inch. As such, when an end user places a compressed charge 2, according to the present invention, which is sized for a 50-caliber firearm within the muzzle end 22 of the barrel 24 (see FIG. 4), the leading end portion 14 of the compressed charge 2 is readily received therein until an intermediate region or portion 15 of the four sidewalls 8, 9 abuts with an inwardly facing annular perimeter edge surface 20 of the muzzle end 22 of the barrel 24. Such abutting engagement inhibits further free unrestricted movement of the compressed charge 2 into the muzzle end 22 of the barrel 24. The engagement (i.e., contact) results from the oversizing or interference fit of the trailing edge end portion 16 of the compressed charge 2, which has a diagonal dimension of approximately 0.501 and 0.540 inches or so, preferably about 0.517 of an inch or so, which is being attempted to be inserted within the barrel 24 of the 50-caliber firearm typically having a nominal diameter bore 23 or dimension of about 0.500 inches. As a result of such slight oversizing or interference fit, the end user has to exert a slight loading force on the trailing end wall 6 of the compressed charge 2 to force the compressed charge completely within the muzzle end 22 of the barrel 24, e.g., insertion of the compressed charge within the muzzle end 22 of the barrel 24 about an inch or more in order to provide sufficient room for accommodating a desired projectile.

Figure 5:
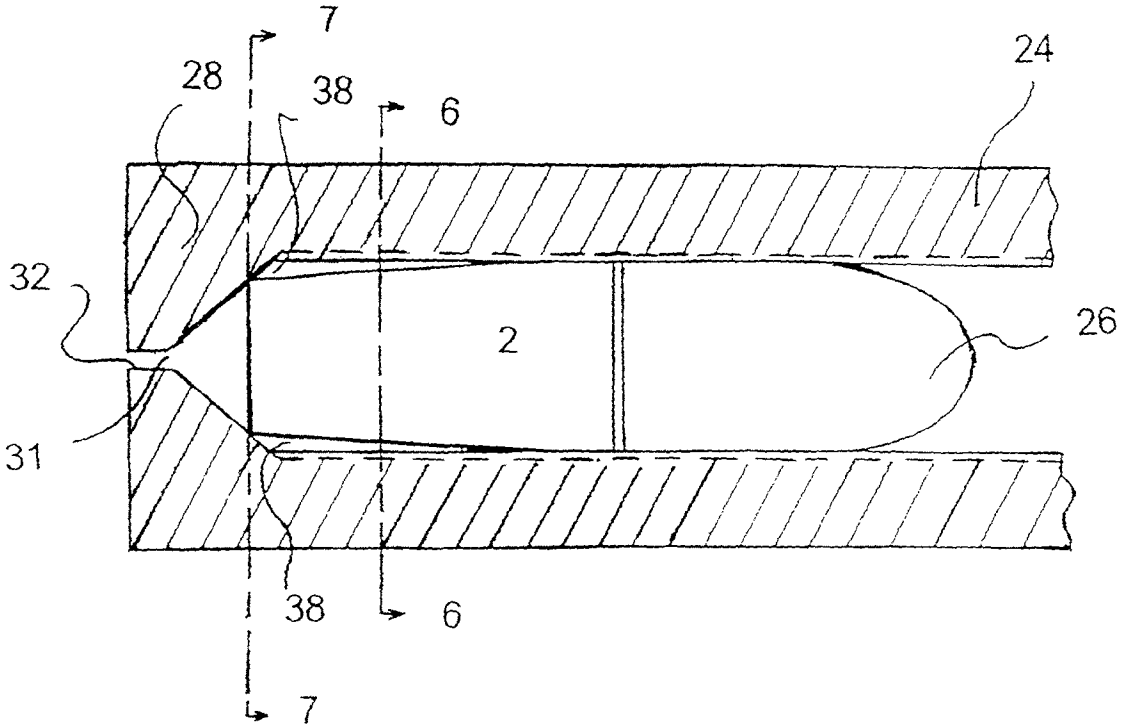
FIG. 5 diagrammatically shows the loaded end position of the premeasured compressed charge of FIG. 1 in the breech end of the barrel adjacent the flash channel.

Once the compressed charge 2 has been sufficiently forced into the muzzle end 22 of the muzzleloader barrel 24, e.g. by about an inch or more, to provide sufficient space to accommodate a desired bullet or projectile 26, the end user will then insert the desired bullet or projectile 26, and possibly a sabot or patch (wad), within the muzzle end of the barrel 24 and "ram" the bullet or projectile 26, along with the previously loaded propellent charge(s) 2 and, if present, the sabot or patch (wad) toward the breech end 28 of the barrel 24 such that the leading end wall 4 of the charge 2 is positioned directly opposite but closely adjacent the outlet 31 of the flash channel 32 (see FIG. 5). While the above description only discusses loading of a single propellent charge 2, it is to be appreciated that possibly two or more propellent charges 2 may be sequentially loaded within the muzzle end 22 of the barrel 24 prior to insertion of the desired bullet or projectile 26 and possibly a sabot or patch (wad), to achieve a desired gun charge within the barrel 24 as long as the loaded charge does not exceed the rifle manufacturer's prescribed gunpowder load recommendation.

During insertion of the compressed charge 2 into the muzzle end 22 of the barrel 24, four small triangular wedge-shaped sections 30 (see FIGS. 1-3) are generally shaved, scraped off or otherwise removed from the compressed charge 2. These four small triangular wedge-shaped sections 30 generally comprise elongate narrow triangular wedges which commence along the intermediate region or portion 15 and extend toward the trailing end wall 6 of the compressed charge 2. Each small triangular wedge-shaped section 30 is removed, shaved or scraped off from the compressed charge 2 due to the interference fit, between the compressed charge 2 and the internal diameter or dimension of the bore 23 of the firearm, and the shaved off or removed gunpowder typically falls into the barrel 24 and drops toward the breech end 28 thereof due to gravity. This shaved off or removed generally loose powder is located closely adjacent to the outlet 31 of the flash channel 32 of the firearm. Accordingly, upon discharge of the firearm, this loose gunpowder quickly ignites and assists with intensifying the ignition, and possibly the heat, supplied through the flash channel 32 by the percussion cap, or some other conventional ignition device, to facilitate a more rapid and complete burning of the compressed charge 2.

The shaving off or removal of a portion of each of the four longitudinal edges of the compressed charge 2, from the intermediate portion 15 toward the trailing end wall 6, reshapes the longitudinal edges of the compressed charge 2 and these reshaped elongate longitudinal edges facilitate maintaining the compressed charge 2 precisely centered within the bore 23 of the barrel 24 as the compressed charge 2 is loaded into the barrel 24 and forced toward the breech end 28 by a ram-rod, in a conventional manner, following insertion of the desired bullet or projectile 26. Flame propagation passageways 36 are defined between the exterior surface of the compressed charge 2 and the inwardly facing surfaces of the breech end 28 of the barrel 24. The centering function of the compressed charge 2, resulting from the interference fit and the shaving of the four longitudinal edges, also assists with trapping a very small amount of ambient air within the breech end 28 of the barrel 24 and this air further assists with a more efficient and complete burning of the compressed charge 2, during discharge of the firearm. Preferably each shaved small triangular wedge-shape section 30 will have a weight of between 0.001 and 1.25 grain velocity equivalent charge (for a total of no more than 5 grain velocity equivalent charge being shaved off or removed for the entire compressed charge 2 during loading of the muzzle loader).

The shaved off gunpowder tends to settle between the compressed charge 2 and the internal diameter of the bore 23 of the firearm thus providing a source of loose granular powder which is located closely adjacent to the outlet 31 of the flash channel 32 and is thus readily ignited by the flame emitted through the flash channel 32 upon detonation of the percussion cap, or some other ignition device. The loose granular combustion source facilitates a better and more complete ignition of the compressed charge 2 and improves the flame propagation along the sidewalls 8, 9 of the compressed charge 2.

Figure 7:
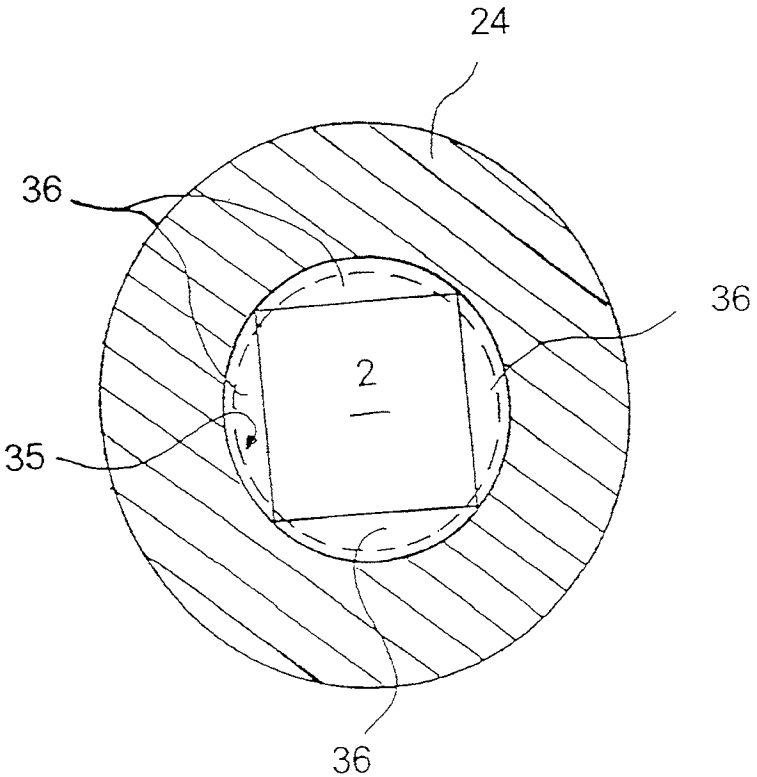
FIG. 7 is a diagrammatic cross-sectional view of the loaded gun barrel along section line 7-7 of FIG. 5.
Figure 8:
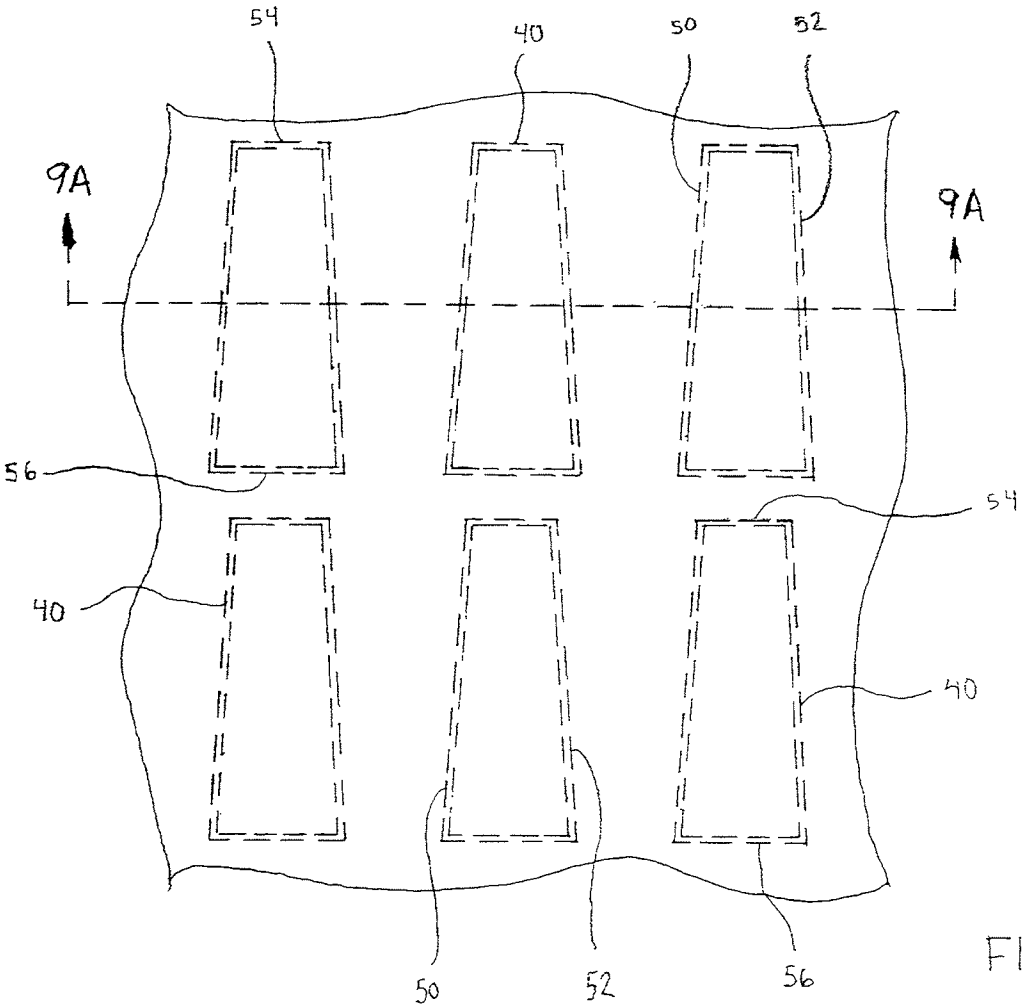
FIG. 8 is a diagrammatic top view of a compression plate above a production plate.

Due to the slightly smaller dimensioned square or rectangular shape of the leading end wall 4 of the compressed charge 2, the surface area of the leading end wall 4 of the compressed charge 2 is smaller than the surface area of a typical circular or cylindrical compressed charge, which is shown in dashed lines as element 35 in FIG. 7. That is, the rectangular leading end wall 4 has a surface area of 0.119 square inches (for a rectangle having a width of 0.316 inch and a height of 0.376 inch and a diagonal dimension of 0.491 inches) while a circular end wall has a surface area of 0.196 square inch (for a circle with a 0.50 inch diameter). In addition, the surface area of the four sidewalls 8, 9 of the compressed charge 2 is greater than the exposed surface area for a cylindrical pellet having an identical diameter and similar grain velocity equivalent charge, i.e., the surface area for the four sidewalls is 1.358 square inches, for a compressed charge 2 having a 0.45 inch diagonal along the leading end wall, a 0.510 inch diagonal along the trailing end wall and 1.0 axial length, while the surface area for a cylindrical pellet is 1.159 square inches, for a pellet having a 0.45 inch diameter across the leading end wall, and a 0.82 length. The compressed charge 2 designs, according to the present invention, increase the exposed sidewall surface area by about 5-35%, more preferably 6-20% or so depending upon the particular charge design. The above relates to similar weight compressed charges.

Figure 6:
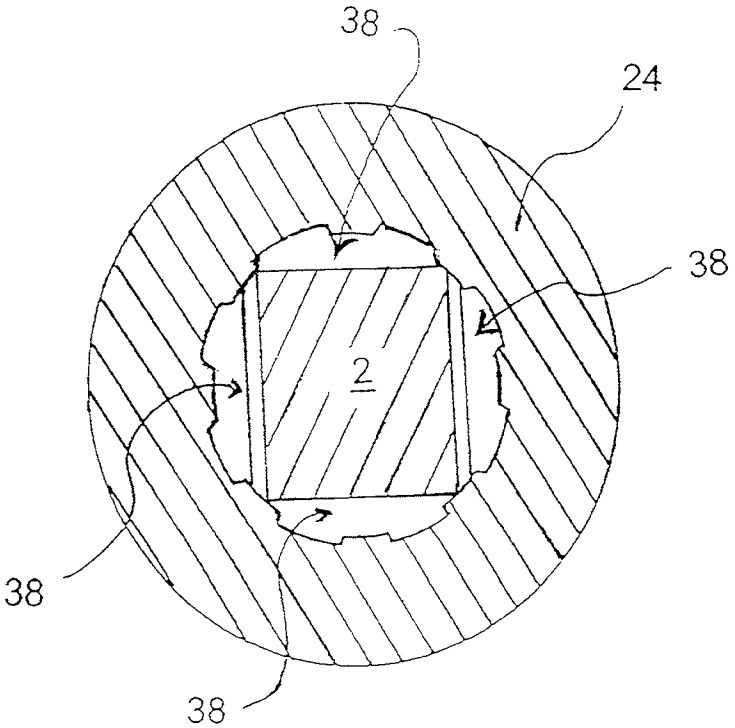
FIG. 6 is a diagrammatic cross-sectional view of the loaded gun barrel along section line 6-6 of FIG. 5.

The smaller surface area of the rectangular or square leading end wall 4 facilitates passage or propagation of the flame, generated by detonation of the percussion cap or other ignition device, around the edges 10 of the leading end wall 4 and along the four passageways 36 and into the four pockets 38 extending along the two pairs of opposed tapered sidewalls 8 and the two pairs of opposed parallel sidewalls 9 of the compressed charge 2 (see FIGS. 5-7). As a result of this configuration of the compressed charge 2, propagation of the flame and burning of the compressed charge 2 is facilitated not only axially along the length of the compressed charge, i.e., from the leading end wall 4 toward the trailing end wall 6, but also burning of the compressed charge 2 is facilitated radially inwardly from an exterior surface of each one of the four sidewalls 8, 9 toward a center of the compressed charge 2. The passageways 36 and pockets 38 facilitate propagation of the flame along the sidewalls 8, 9 to promote radially inward burning of the charge. This arrangement results in a more complete burning of the compressed charge 2 and this minimizes or prevents any rocketing of the compressed charge 2, which remains unburned upon discharge of the bullet or projectile 26 from the breech end 28 of the barrel 24. A complete burning of the compressed charge 2 also facilitates the generation of less unburned components or constituents which may remain within the barrel 24 following discharge of the bullet or projectile 26.

A typical completely loaded position of the bullet or projectile 26 and the compressed charge 2 is shown in FIG. 5.

The inventors believe that the increase in the exposed surface area of the compressed charge 2 as well as compacting or pressing compressed charge 2 with less pressure during the manufacture thereof so that the compressed charge 2 has a more uniform density along its entire axial length facilitates a more complete and rapid burning of the compressed charge 2, following discharge of the firearm. Such complete and rapid burning of the compressed charge 2 results in a minimal amount of unburned residue remaining in the firearm, following discharge thereof. Due to the more complete burning of the compressed charge 2, e.g., the gunpowder, it is less likely that any excessive residue or contaminant(s) will remain in the firearm, following discharge thereof, so that when a subsequent charge is loaded in the firearm, only possibly a minimal or insubstantial amount of residue or contaminant(s) may remain which could be dislodged from the bore 22 of the barrel 24 and clog the flash channel 32 that supplies the flame from the percussion cap or other ignition device to ignite the compressed charge 2, e.g., the compressed charge 2 contained within the breech end 28 of the barrel 24.

With reference to FIGS. 8, 9A, 9B and 9C, a device for use in carrying out the method of manufacturing the compressed charge 2, according to the present invention, will now be discussed. The method commences with a suitable gunpowder manufactured from raw materials, for example, such as those listed above or alternatively manufactured in accordance with U.S. Pat. No. 5,557,151, black powder, a black powder substitute or smokeless gun powder. To facilitate manufacture of a uniform gunpowder, each of the raw materials, used to manufacture the gunpowder, is screened and sized by a sizing/screening process. However, in order to facilitate more accurate control and uniformity of the manufactured compressed charges, a preferred form of the invention does not utilize any so called "fines" during the manufacturing process.

After the sizing process, the screened and sized raw materials, e.g., the potassium perchlorate, the potassium nitrate, the fuel component (such as ascorbic acid) and the hardwood charcoal and/or carbon (lamp) black, are all combined with one another in the desired proportions and then thoroughly blended together with one another in a ball mill, a hammer mill, or some other conventional or suitable mixing apparatus to form a substantially uniform mixture of the gunpowder. The blending step is particularly important to manufacture the gunpowder. Typically the gunpowder is blended together in the mixing apparatus for a duration of between about 15 to about 45 minutes or so.

Gunpowder which is manufactured from adequately sized and screened raw materials is typically easier to load within the molds and tighter control of the gunpowder size provides better gunpowder loading control and consequently more accurate control over the weight of the compressed charges 2 since the gunpowder tends to flow more evenly into each cavity 40 during the mold filling procedure. If the manufactured gunpowder is too large or clumpy, the gunpowder is typically reduced in size to a desired particle size, e.g., the gunpowder is preferably reduced to a particle size where most of the particles range between about 1 micron and about 1000 microns, for example, prior to use.

Either during the blending step, and/or immediately following the blending step, a sufficient amount of moisture is added to the gunpowder being manufactured in order to produce a uniform mixture of the gunpowder which will typically contain between about 0.01 and about 20.0% by weight of moisture, more preferably contain between about 1% and about 10% by weight of moisture. If the dampened and blended gunpowder is not utilized immediately after manufacture but is to be temporarily stored for a period of time prior to proceeding to the pressing step, then additional water or moisture may be sprayed or added to the gunpowder prior to pressing of the same. If an application dictates substantially no pressing force to manufacture the compressed charge 2, i.e., to facilitate a still more uniform density both axially along and radially of the compressed charge 2, then a uniform mixture of gunpowder is formed into a slurry, i.e., a uniform gunpowder mixture generally having a moisture content of greater than 10.0% by weight of water in a wet state. After the slurry is formed, the gunpowder slurry is then poured into the desired cavity/cavities 40, having the desired charge shape, and this slurry is then allowed to dry and harden and form the desired compressed charge 2.

To assist with mass production of compressed charges 2, a fixed intermediate mold plate 43 has a plurality of individual cavities 40 of a desired shape and size formed therein. That is, each intermediate mold plate 43 typically has a plurality of separate individual cavities 40, e.g., between ten and a few hundred or so individual cavities 40 formed therein, such that a plurality of compressed charges 2 can be simultaneously pressed and manufactured during a single pressing cycle of the mold, unless a continuous, automated production is utilized (i.e., an extruder or rotary press, for example). Each one of the cavities 40 is shaped to form a desired compressed charge 2, as described above, having the desired grain size and overall dimensions.

Each cavity 40 will have a desired axial length, e.g., each cavity will have an axial length of about 2⅔ inches (for a 200 grain velocity equivalent charge), about 2 inches (for a 150 grain velocity equivalent charge), about 1⅝ (±⅛) inches (for a 100 grain velocity equivalent charge), about 0.85 (±0.10) inches (for a 50 grain velocity equivalent charge) and about 0.40 (±0.10) inches (for a 30 grain velocity equivalent charge), while the opposed pair of side walls 50, 52, for each of the cavities 40, taper toward one another from the trailing end wall 56 of the cavity 40 toward a leading end wall 54 of the cavity 40. Each cavity 40 will typically have a depth or height of about 1 inch or so such that the thickness of the loose gunpowder is compressed to less than about 50% of its loose granular height during the pressing step. The leading end wall 54 and the trailing end wall 56 of each cavity 40 are both planar surfaces and extend parallel to one another and perpendicular to a bottom molding surface 44 of the cavity 40 which is formed by a top surface of the production plate 42. The production plate 42 is raised into engagement with a bottom surface of the intermediate mold plate 43 (see FIGS. 9A-9C). A top molding surface 46 of the compression plate 48 and the bottom surface 44 of the cavity 40, i.e., the top surface of the production plate 42, are both planar and extend parallel to one another, during the pressing step, as well as perpendicular to the tapered side walls 50, 52 and perpendicular to the leading end wall 54 and the trailing end wall 56.

The top molding surface 46 of the compression plate 48 generally has a trapezoidal shape which is slightly smaller in size then the trapezoidal shaped opening providing access to the cavity 40 (see FIG. 8) so that the top molding surface 46 of the compression plate 48 is closely accommodated and received within the cavity 40 during the pressing step. As a result of the design of the top molding surface 46 and the cavity 40, the pressure applied to the leading end wall 4 and the trailing end wall 6 of the compressed charge 2, during the pressing step, is substantially equal and uniform. Such substantially equal and uniform pressure assists with avoiding a potential uneven density of gunpowder within and along the axial longitudinal length of the compressed charge 2.

The inventors have found that it is particularly important to ensure that the density and/or compaction of the gunpowder, especially adjacent the leading end wall 4 of the compressed charge 2, is preferably equal to or less than a density and/or compaction of the gunpowder at the trailing end wall 6 of the compressed charge 2—the density and/or compaction of the gunpowder adjacent the leading end wall 4 is about 0% to about 5% less than a density and/or compaction of the gunpowder adjacent the trailing end wall 6, more preferably the density and/or compaction of the gunpowder adjacent the leading end wall 4 is about 0.1% to about 4% less than a density and/or compaction of the gunpowder adjacent the trailing end wall 6. By forming the leading end wall 4 with a density/compaction of the gunpowder which is preferably equal to or slightly less than a density/compaction of the gunpowder adjacent the trailing end wall 6 of the compressed charge 2, a small amount of additional air is trapped within this gunpowder and this trapped additional air is available for combustion and also tends to promote rapid burning of the gunpowder upon discharge of the firearm. Furthermore, when the trailing end wall 6 is more dense and/or compact, this renders the trailing end wall 6 slightly harder and thus more durable during manufacture, handling, packaging, shipping and loading. Compressed charges which have a leading end wall 4 with a gunpowder density/compaction which is greater than the gunpowder density/compaction adjacent the trailing end wall 6 tend to trap less air which is available for combustion discharge of the firearm and thus tend to burn slower and less completely.

Figure 9A:
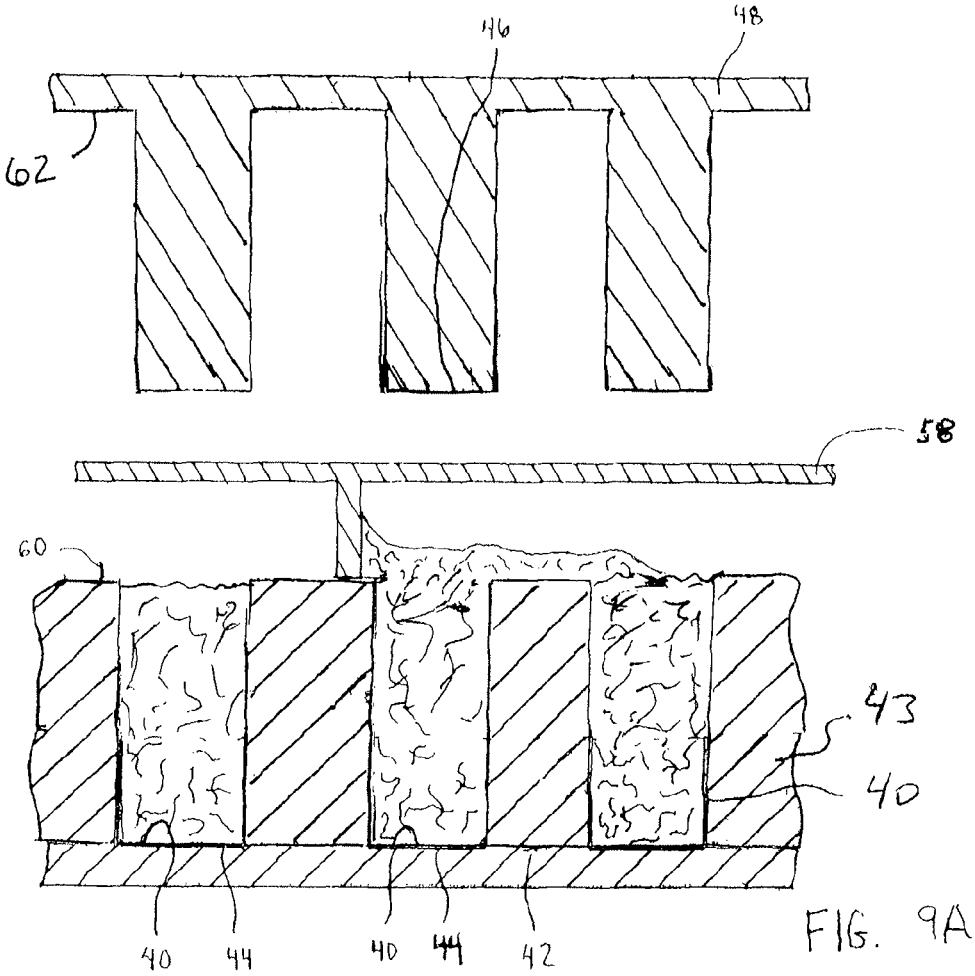
FIG. 9A is a diagrammatic cross-sectional view along section line 9A-9A of FIG. 8 showing the compression plate located above the production plate while the rake is preforming its sweeping function.

Following application of sufficient moisture to the uniform mixture of gunpowder, a sufficient amount of the moistened gunpowder is then placed on the top surface 60 of the intermediate mold plate 43 and this gunpowder is utilized for completely filling each one of the individual cavities 40 formed within the intermediate mold plate 43. As shown in FIG. 9A, a rake 58 is dragged across the top surface 60 of the intermediate mold plate 43 and this rake 58 "sweeps" the loose granules of gunpowder into the cavities 40. The rake 58 can be dragged across the intermediate mold plate 43 in only a single pass or, more typically, the rake 58 is dragged or moved to and fro, across the top surface 60 of the intermediate mold plate 43, a number of passes until the operator is certain that each one of the cavities 40 is properly filled with a sufficient amount of the loose gunpowder, e.g., each cavity 40 is sufficiently filled to capacity to ensure the proper grain weight/grain size for each compressed charge 2 to be manufacture. While dragging the rake 58 across the top surface 60 of the intermediate mold plate 43, the rake 58 levels the gunpowder, accommodated within each cavities 40, such that the level of the gunpowder is flush or even with a plane defined by the top surface 60 of the intermediate mold plate 43. In this manner, each of the cavities 40 is completely filled to capacity with a substantially equal amount of gunpowder, prior to initiation of the compressing step, thereby ensuring a substantially uniformity weight for each compressed charge to be formed from one production cycle to the next production cycle. Before the step of pressing the gunpowder into compressed charges 2 occurs, a final "sweeping" pass of the rake 58, across the top surface 60 of the intermediate mold plate 43, removes any excess loose gunpowder therefrom which may possibly interfere with the pressing cycle. The final "sweeping" pass prevents compression of loose gunpowder between the top surface 60 of the intermediate mold plate 43 and the lower surface 62 of the compression plate 48 and assists with promoting a level, even distribution of applied pressure between the compression plate 48 and the production plate 42, further facilitating uniformity between compressed charges 2 from one production cycle to the next production cycle.

Figure 9B:
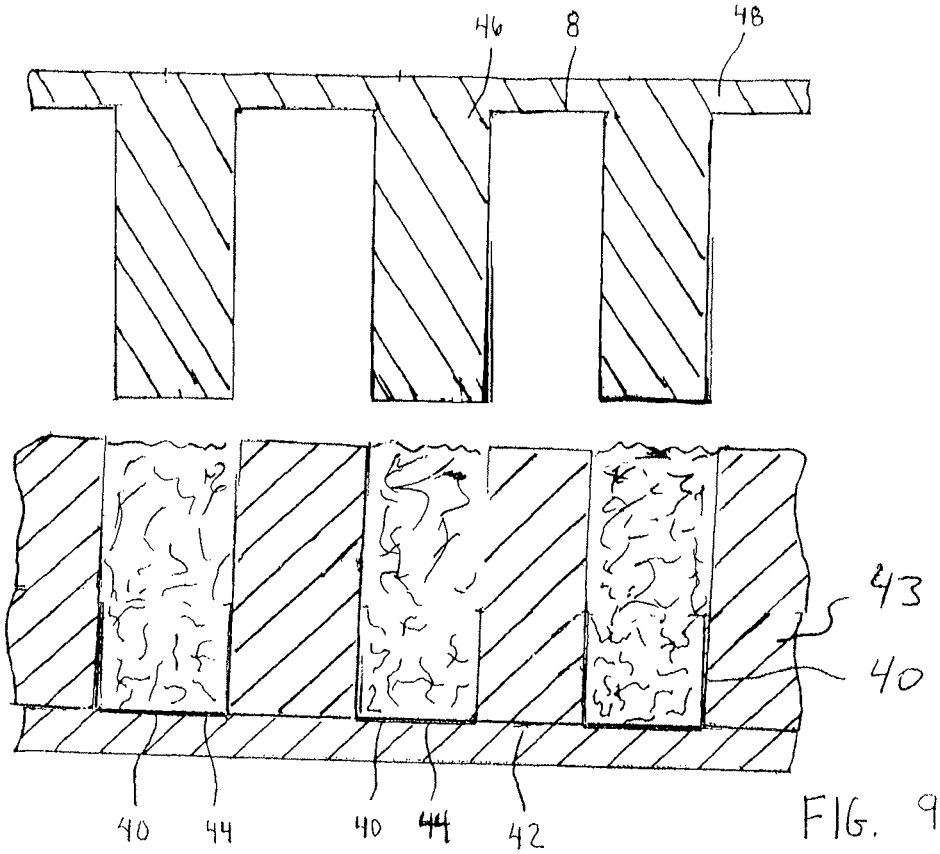
FIG. 9B is a diagrammatic cross-sectional view, similar to section line 9A-9A of FIG. 8, showing the compression plate partially lowered toward the production plate prior to commencing the pressing process.

After each of the cavities 40 is filled and any excess loose gunpowder is swept and removed from the top surface 60 of the production plate 42, the pressing step commences. As shown in FIG. 9B, the compression plate 48 is lowered toward the intermediate mold plate 43 and the production plate 42 such that each mating top molding surface 46 is properly aligned with a mating respective cavity 40. Upon further lowering and pressing movement of the compression plate 48 toward the production plate 42, the top molding surface 46 is received and accommodated within a respective cavity 40.

As the top molding surface 46 is forced into the cavity 40, the pressure applied by the top molding surface 46 is transferred to the gunpowder contained within the mold 40. This pressing force sandwiches the gunpowder between the pair of parallel, planar molding top and bottom molding surfaces 44, 46. As the four side walls 50, 52, 54, 56 are stationary and there is only relative movement between top molding surface 46 and the bottom surface 44, the gunpowder tends to be uniformly compressed and may possibly flow, shift and/or migrate within the cavity 40 from the narrower leading end portion toward the wider trailing end portion so that the density and/or compaction, especially adjacent the leading end wall 4 of the compressed charge 2 is equal to or less than the density and/or compaction adjacent the trailing end wall 6 of the compressed charge 2. Such migration assists with slightly decreasing the density and/or compaction adjacent the leading end and slightly increasing the density and/or compaction adjacent the trailing end of the compressed charge 2 which, in turn, renders the trailing end portion of the compressed charge 2 slightly more durable, as discussed above.

Figure 9C:
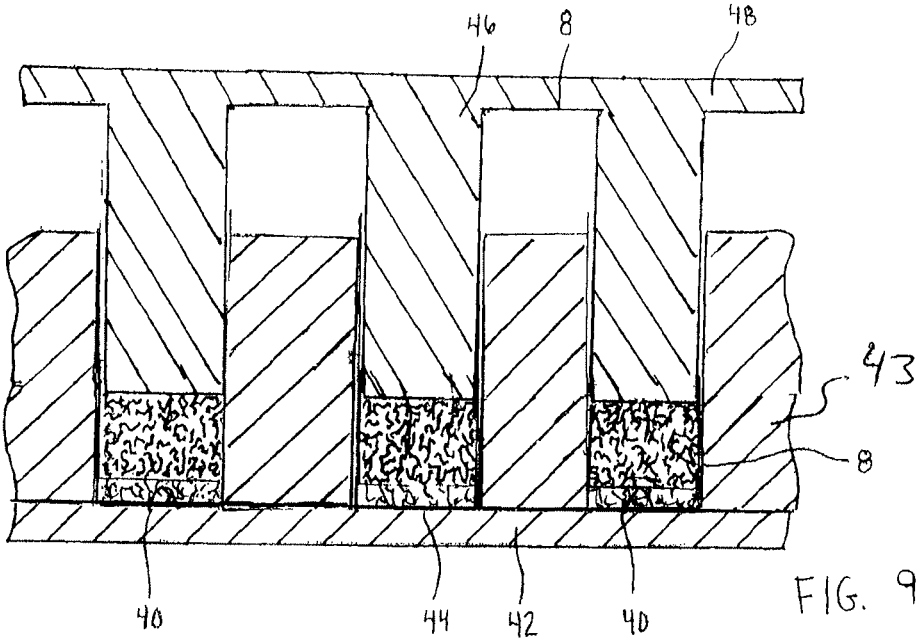
FIG. 9C is a diagrammatic cross-sectional view, similar to section line 9A-9A of FIG. 8, showing the compression plate following completion of its downward pressing movement to form the compressed charges.

The sandwiching force biases the gunpowder against the leading end wall 54, the trailing end wall 56, the pair of tapered side walls 50, 52 as well as against the bottom surface 44 and the top molding surface 46 of the respective cavity 40. The applied pressure induces the gunpowder to conform to the shape of the respective cavity 40 as can be seen in FIG. 9C. The applied pressure generates an approximately equal pressure to the compressed charge being formed but with the density and/or compaction of gunpowder being either uniform or slightly less compact adjacent the leading end portion 14 of the compressed charge 2.

As is conventional in the art, the compression plate 48 is forced or pressed toward the production plate 42 to a desired stop position using, for example, a hydraulically actuated press, a pneumatically actuated press, a mechanically actuated press, an electric drive or motor, etc. Using the inventive formulation and method discussed above along with a reduced pressure to manufacture the compressed charge 2, in comparison to the typical range of pressures commonly used for production of some other compressed charges, achieves a fast and more complete burning compressed charge 2. For some know compressed charges, typical pressures utilized for formation of the same range from between 60 and 100 psi of pressure. However, with the inventive formulation and method, a reduced pressure of a low as about 5 psi but more typically between 25 and 40 psi is applied to the loose gunpowder, contained within the cavity 40, to form the desired compressed charges 2. Such reduced pressure allows formation of a compressed charge 2 which will, once adequately dried, still have a desired structural integrity while also promoting desired flame propagation along and through the compressed charge 2 during ignition.

Figure 9D:
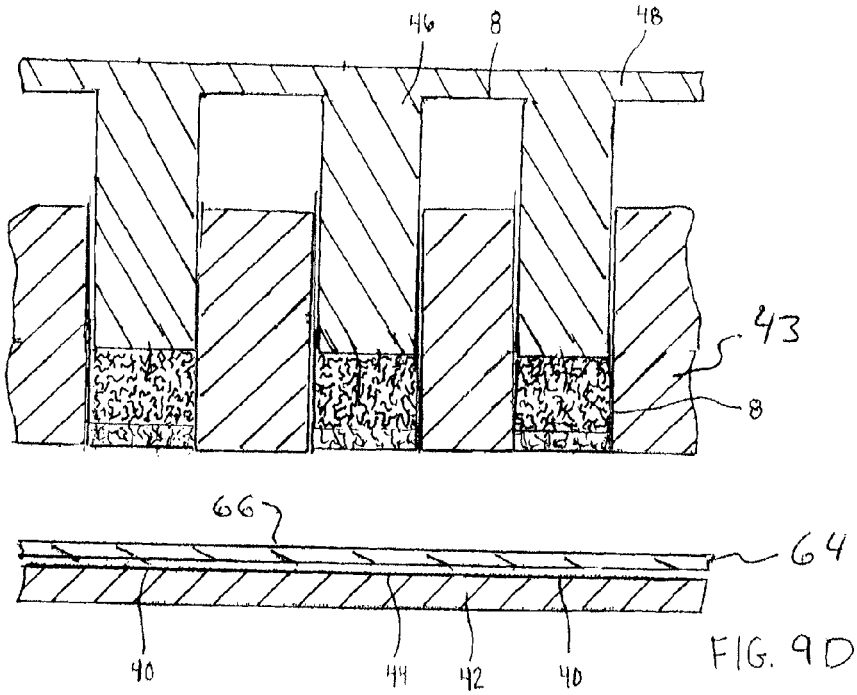
FIG. 9D is a diagrammatic cross-sectional view, similar to section line 9A-9A of FIG. 8, showing the compression plate following completion of its downward pressing movement with bottom production plate being lowered out of engagement with the bottom surface of the intermediate mold and the insertion of the drying tray.
Figure 9E:
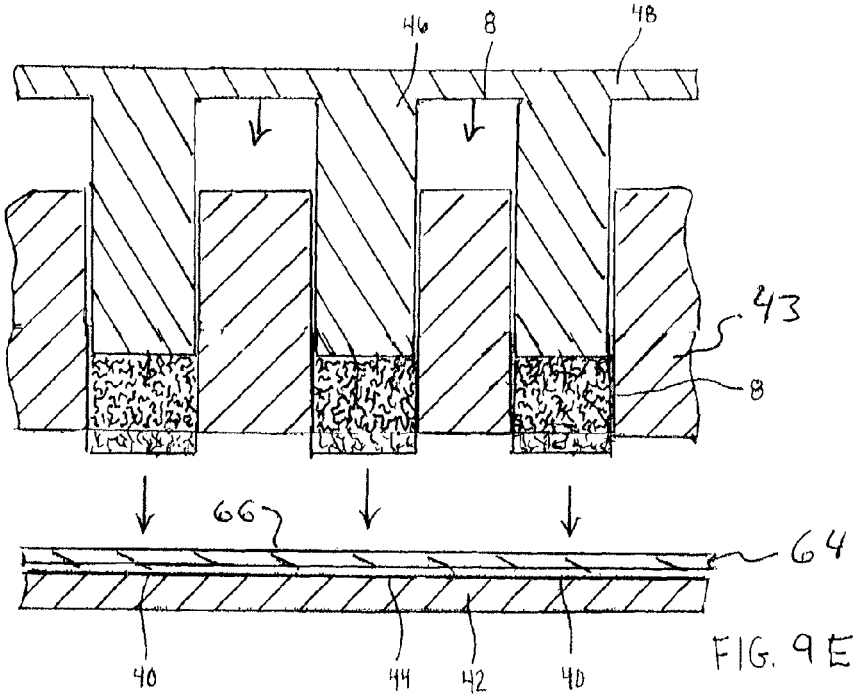
FIG. 9E is a diagrammatic cross-sectional view, similar to section line 9A-9A of FIG. 8, showing the drying tray inserted between the lowered bottom production plate and the intermediate mold, which receives the ejected compressed charges.

Once the gunpowder is sufficiently pressed within the cavity 40 and conforms to the shape of the respective cavity 40, the production plate 42 is lowered sufficiently away from both the intermediate plate 43 and the compression plate 48. Once the production plate 42 is sufficiently spaced from the intermediate plate 43 and the compression plate 48, a drying tray 64 is inserted between the production plate 42 and the bottom surface of the intermediate plate 43 (see FIG. 9D). Once the drying tray 64 is positioned as shown in FIG. 9D, the manufactured compressed charges 2 can then be released/ejected from the cavity 40 by a further downward pressing motion of the compression plate 48 relative to the intermediate plate 43. Such movement normally ejects each one of the manufactured compressed charges 2 from the respective cavity 40 and onto the top surface 66 of the drying tray 64 (see FIG. 9E). Thereafter, the compression plate 48 is lifted away from the production plate 42 so that each mating top molding surface 46 is completely withdrawn from its respective cavity 40 and the production plate 42 is raised so as to abut against the bottom surface of the intermediate plate 43 so that the press is positioned for another pressing cycle.

Care should be taken when removing the compressed charges 2 from the cavities 40 as the compressed charges 2 are very fragile immediately after being compressed. The manufactured compressed charges 2 remain fragile until they are adequately dried to remove the excess moisture applied thereto during the manufacturing process. The entire pressing cycle typically lasts about thirty (30) seconds or so. The drying step typically reduces the moisture content of compressed charge 2 to a desired level of between about 1% to about 10% with a preferred range of between about 2% to about 7% by weight depending on the particular application, e.g., the wet weight being approximately 96 grains while the dry weight is approximately 90.7 grains (in a preferred example of a 150 grain velocity equivalent charge with an increased percentage of potassium perchlorate contained therein). As the moisture is gradually removed from the compressed charge 2 during the drying process, the hardness of the compressed charge 2 gradually increases.

To assist in the drying process, the manufactured compressed charges 2, are normally transported or conveyed, via the drying tray 64, to a drying area or room having a low relative humidity where the compressed charges 2 are allowed to dry naturally or, alternatively, the compressed charges 2 may be placed within a conventional moisture removing device, such as a forced or passive drying device, to accelerate driving off and/or removing the excess moisture from the compressed charges 2 at a more rapid pace.

Figure 14:
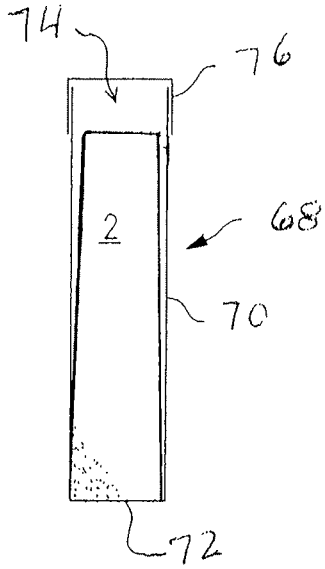
FIG. 14 is a diagrammatic view of a transport container for transport of a compressed charge.

Finally, the compressed charges 2 are packed in a desired package or container and the packaged product is then ready for shipment and sale. The desired package or container, containing a plurality of compressed charges 2 therein, is normally packaged with one or more portable transport containers 68 to facilitate safe and dry transport of a compressed charge 2. As shown in FIG. 14, each portable transport container 68 comprises an elongate tubular section 70 which is normally closed at one end 72 and open at the opposite end 74. A resealable cover 76 is provided for releasably closing the open end 74 of the transport container 68. A user will typically remove the cover 76 and then insert one of the compressed charges 2 within the open end 74 of the transport container 68 and then affix the cover 76 to the open end 74. When the compressed charge 2 is required, the user will removed the cover 76, withdraw the compressed charge 2 from the transport container 68, and utilize the compressed charge 2 to discharge the firearm, as discussed above. Thereafter, the transport container 68 may be reused to facilitate safe and dry transport of further compressed charge(s) 2.

Turning now to FIG. 15, a further embodiment of the compressed charge 80, according to the present invention is shown. As can be seen in this figure, the compressed charge 80 generally has the shape of a cube in which each of the six faces 82 of the compressed charge 2 are substantially identical to one another. It is to be appreciated that the cube can be sized such that the diagonal D along each one of the faces 82 of the compressed charge 80 has an interference fit with the gun barrel of the intended firearm. For example, for a 50 caliber barrel, the diagonal D of the face 82 of the cubic shaped compressed charge 2 can be approximately between 0.501 to 0.540 inches. Alternatively, if so desired, the diagonal D can be slightly smaller (e.g., anywhere from 0.0005 inches to 0.400 and more preferably between 0.001 and 0.100 inches) than the gun barrel of the intended firearm so that the compressed charge 80 can be readily inserted into and received by the muzzle end of the firearm by an operator and conveyed to the breech end of the firearm with minimal or no effort.

With reference to FIG. 16, an embodiment of the compressed charge 84 having a generally spherical shape is shown. According to this embodiment, the spherical compressed charge 84 may have a diameter which is slightly larger than the diameter of the gun barrel of the intended firearm so that the compressed charge 84 has a slight interference fit therewith, e.g., the diameter of the spherical compressed charge 84 is approximately between 0.001 to 0.040 of an inch larger than the diameter of the gun barrel of the intended firearm. Alternatively, the diameter of the spherical compressed charge 84 can be slightly undersized or smaller (e.g., anywhere from 0.0005 inches to 0.400 and more preferably between 0.001 and 0.100 inches), than the diameter of the gun barrel of the intended firearm so that the spherical compressed charge 84 will be readily inserted into and received by the muzzle end of the firearm by an operator and, thereafter, can be conveyed to the breech end of the firearm with minimal or no effort.

Two variation of conical shaped compressed charges 86 are shown with reference to FIGS. 17A and 17B. The leading end 88 of the conical compressed charge 86 can either be substantially pointed, as shown in FIG. 17A, or be generally flat circular surface, as shown in FIG. 17B. The leading end 88 of the conical compressed charge 86 is smaller (e.g., anywhere from 0.0005 inches to 0.400 and more preferably between 0.001 and 0.100 inches) than the diameter of the gun barrel of the intended firearm so that the leading end 88 of the conical compressed charge 86 will be readily inserted into and received by the muzzle end of the firearm. As with the previous embodiments, the trailing end 90 of the conical shaped compressed charge 86 may either have a slight interference fit with the gun barrel of the intended firearm, i.e., the trailing end is between approximately 0.001 to 0.040 inches larger than the diameter of the gun barrel of the intended firearm or, alternatively, the trailing end 90 can be can be slightly undersized or smaller, (e.g., anywhere from 0.0005 inches to 0.400 and more preferably between 0.001 and 0.100 inches) than the diameter of the gun barrel of the intended firearm so that the conical compressed charge 86 will be readily inserted into and received by the muzzle end of the firearm by an operator and, thereafter, can be conveyed to the breech end of the firearm with minimal or no effort.

With reference to FIG. 18, a generally cylindrical shaped compressed charge 92 is shown. The cylindrical shaped compressed charge 92 can either have an interference fit with the gun barrel of the intended firearm, e.g., be between approximately 0.001 to 0.040 inches larger than the diameter of the gun barrel of the intended firearm, or, alternatively, the cylindrical shaped compressed charge 92 can be can be slightly undersized or smaller (e.g., anywhere from 0.0005 inches to 0.400 and more preferably between 0.001 and 0.100 inches) than the diameter of the gun barrel of the intended firearm so that the cylindrical compressed charge 92 will be readily inserted into and received by the muzzle end of the firearm by an operator and, thereafter, can be conveyed to the breech end of the firearm with minimal or no effort.

Two slight variations of the cylindrical shaped compressed charge 92 of FIG. 18 are shown in FIGS. 19A and 19B. According to this embodiment, the trailing end of the cylindrical compressed charge 92 is provided with an annular rim 94. The annular rim 94 is generally slightly oversized so that the annular rim 94 has an interference fit with the gun barrel of the intended firearm while a majority of the cylindrical compressed charge 92 is slightly undersized (e.g., anywhere from 0.0005 inches to 0.400 and more preferably between 0.001 and 0.100 inches) so that the leading portion of the cylindrical shaped compressed charge readily inserted into and received by the muzzle end of the firearm. If the annular 94 rim is slightly larger than the diameter of the gun barrel of the intended firearm, then the operator must bias the trailing end of the cylindrical compressed charge 92 into the muzzle end of the gun barrel toward the breech end of the firearm. Alternatively, if the annular rim 94 is undersized, the entire compressed charge 92 will be readily inserted into and received by the muzzle end of the firearm by an operator and conveyed to the breech end of the firearm with minimal or no effort. If the annular rim 94 is oversized, then a leading surface of the annular rim 94 may be tapered (as shown in FIG. 19B) to facilitate receiving the annular rim 94 within the muzzle end of the gun barrel of the intended firearm.

With reference to FIG. 20, a further modification of the cylindrical compressed charge 92 is shown. According to this embodiment, at least one annular step or transition 96 is located between the leading end 98 of the cylindrical compressed charge 92 and the trailing end 100 of the cylindrical compressed charge 92. As a result of such step or transition 96, the diameter of the leading end 98 is smaller than the diameter of the trailing end 100. Further, the entire leading end 98 is undersized (e.g., anywhere from 0.0005 inches to 0.400 and more preferably between 0.001 and 0.100 inches) with respect to the gun barrel of the intended firearm. The entire trailing end 100 of the cylindrical compressed charge 92 can either be slightly oversized, e.g. by a few thousandths of an inch or so, than the gun barrel of the intended firearm so that the trailing end 100 of the cylindrical compressed charge 92 must be forced into the muzzle end of the gun barrel. Alternatively, the trailing end 100 of the cylindrical compressed charge 92 may be slightly undersized, by a few thousandths of an inch or so, such that the trailing end 100 will be readily inserted into and received by the muzzle end of the firearm by an operator and conveyed to the breech end of the firearm with minimal or no effort. It is to be appreciated that the step or transition 96, if so desired, may be a gradual transition, e.g., a tapered surface, rather than an abrupt transition as shown in FIG. 20.

Depending upon the particular application, it is to be appreciated that the maximum dimension for either, or both, the leading end and the trailing end, i.e., either the diameter or the diagonal, of all of the previously discussed embodiments of the compressed charge, may be completely slightly undersized for the desired caliber of the intended firearm (e.g., anywhere from 0.0005 inches to 0.400 inches and more preferably between 0.001 and 0.100 inches) such that the entire compressed charge will be readily inserted into and received by the muzzle end of the firearm by an operator and conveyed to the breech end of the firearm with minimal or no effort.

It is to be appreciated that while the above discussion contemplates the compressed charge to be inserted from the muzzle end of the firearm, it is also within the spirit and scope of the present invention to insert the projectile from the breech end of the barrel, and such insertion is then followed by insertion a sabot and/or patch (wad) if necessary, and then the compressed charge in the breech end of the barrel. Thereafter, the firearm can be discharged in a conventional manner. Alternatively, the compressed charge can be used in a black powder firearms, such as a multiple shot pistol, or a variety of other conventional and well known firearms currently available on the market. The compressed charge is also suitable to be loaded in a cartridge for manufacture of a conventional casing which has a percussion cap or primer incorporated in a base of the cartridge.

As a result of the improved gunpowder formulation, which contains a slightly increased percentage of potassium perchlorate therein, a more powerful gunpowder is obtained and this more powerful gunpowder facilitates manufacture of axially shorter compressed charges which are still more powerful than a comparable prior art compressed charge. Axially shorter compressed charges tend to be more durable and the shorter axial length reduces the likelihood of the compressed charge partially breaking up or disintegrating during shipment, handling and/or loading. Additionally, shorter more powerful compressed charges tend to be more convenient and safer than prior art compressed charges since only a single compressed charge need be employed to obtain the same amount of power as multiple compressed charges while also increasing the uniformity from one shot to the next.

One known method for producing gunpowder, suitable for use in manufacturing the compressed charge, is disclosed in U.S. Pat. No. 5,557,151 and those teachings of this reference are incorporated herein by reference. It is to be appreciated that other conventional gun powders (e.g., black powder, black powder substitutes, smokeless gun powder, etc.) can also be used in accordance with the teachings of the present invention.

It is to be appreciated that this technology is also applicable to propellants, small rocket motors for model rockets, air bags, initiators for munitions and other military applications and as a variety of other applications not discussed in further detail.

Since certain changes may be made in the above described improved compressed charge and method of manufacturing the same, without departing from the spirit and scope of the invention herein involved, it is intended that all of the subject matter of the above description or shown in the accompanying drawings shall be interpreted merely as examples illustrating the inventive concept herein and shall not be construed as limiting the invention.

Wherefore, we claim:

1. A method of manufacturing a premeasured compressed charge for use with an intended black powder firearm having barrel with a desired caliber, the compressed charge having a leading end portion with a smaller dimension than both a trailing end portion and the desired caliber of the intended firearm, and the trailing end portion having a larger diagonal dimension than the desired caliber of the firearm such that the leading end portion of the compressed charge is received within the barrel of the firearm while the trailing end portion having an interference fit must be forced into the barrel of the firearm, the method comprising the steps of:

providing a mold having at least one cavity therein, and each cavity having a pair of opposed side walls which taper toward one another from a trailing end wall of the cavity toward the leading end wall of the cavity and a bottom molding surface of the cavity which extends normal to each of the opposed side walls and the two end walls;

filling the cavity of the mold with gunpowder having a sufficient moisture content;

pressing gunpowder contained within the cavity with a top molding surface, which extends parallel to the bottom molding surface, such that the gunpowder within the cavity is sandwiched between the parallel top and bottom molding surfaces and form the compressed charge and, as a result of such pressing, the formed compressed charge only tapers along two surfaces and one of a density and a compaction of the gunpowder, adjacent the leading end portion of the compressed charge, is about 0% to about 5% less than one of the density and the compaction of the gunpowder adjacent the trailing end portion to facilitate a more complete combustion of the compressed charge upon discharge of the firearm; and releasing the compressed charge from the cavity of the mold.

2. The method according to claim 1, further comprising the step of, before the pressing step, dragging a rake across a top surface of the mold to ensure that each cavity is filled with a sufficient amount of gunpowder for manufacturing the compressed charge.

3. The method according to claim 1, further comprising the step of manufacturing the compressed charge from gunpowder having a particle size ranging of between about 1 micron and about 1000 microns.

4. The method according to claim 1, further comprising the step of adding between about 1% and about 10% by weight of moisture to the gunpowder before manufacturing the compressed charge therefrom.

5. The method according to claim 1, further comprising the steps of utilizing cavities which have depth of approximately 1 inch and an axial length of one of about 2⅔ inches, about 2 inches, about 1⅝ inches, about 0.85 inches and about 0.40 inches and compressing the gunpowder, contained within the cavity, to a height of less than about 50% of its original height before pressing.

6. The method according to claim 1, further comprising the step of forming each cavity to have a trapezoidal shape and trapping a small amount of additional air within the gunpowder, at least adjacent the leading end portion of the compressed charge, so that this trapped additional air can facilitate combustion and promote rapid burning of the gunpowder upon discharge of the firearm.

7. The method according to claim 1, further comprising the step of pressing the gunpowder so that the trailing end portion of the compressed charge is one of denser and more compact such that the trailing end portion is slightly harder and thus more durable than the leading end portion of the compressed charge.

8. The method according to claim 1, further comprising the step of applying a pressing pressure to the gunpowder, during the pressing step, of between about 25 to about 40 psi when forming the compressed charge.

9. The method according to claim 1, further comprising the step of ejecting the manufactured compressed charge, from the cavity, onto a drying tray and transporting the drying tray to a drying area where the manufactured compressed charge dries.

10. The method according to claim 1, further comprising the step of placing the drying tray, carrying the compressed charge, within a moisture removing device to accelerate driving off and removal the excess moisture from the compressed charge.

11. The method according to claim 10, further comprising the step of reducing a moisture content of the compressed charge, when removing the excess moisture, to a level of between about 1% to about 10% by weight.

12. The method according to claim 1, further comprising the step of using gunpowder formed from a mixture comprising:

10-35% by weight of potassium perchlorate;

25-60% by weight of potassium nitrate;

25-50% by weight of a fuel component; and 0-5% by weight of one of charcoal and carbon (lamp) black to manufacture the compressed charge.

13. The method according to claim 12, further comprising the step of selecting the fuel component from the carbohydrate family.

14. The method according to claim 12, further comprising the step of selecting the fuel component from a group comprising at least one of the following: amino acid, ascorbic acid, sugar, starch, and carbon.

15. The method according to claim 1, further comprising the step of the compressed charge comprises a mixture of:

10-35% by weight of potassium perchlorate;

25-60% by weight of potassium nitrate;

25-50% by weight of a fuel component; and 0-5% by weight of charcoal and carbon (lamp) black.

16. The method according to claim 15, further comprising the step of selecting the fuel component from a group comprising at least one of the following: amino acid, ascorbic acid, sugar, starch, and carbon.

17. The method according to claim 15, further comprising the step of, upon insertion of the compressed charge into the desired caliber of the intended firearm, dislodging four small triangular wedge-shaped sections from the compressed charge, which has an interference fit with the desired caliber of the intended firearm.

18. The method according to claim 17, further comprising the step of permitting at least a portion of the dislodged wedge-shaped sections to fall, by gravity, toward a breech end of the intended firearm to facilitate the flame propagation upon detonation of an ignition device.

19. The method according to claim 1, further comprising the step of selecting the fuel component from the carbohydrate family.

20. The method according to claim 1, further comprising the steps of forming the compressed charge with a diagonal dimension, for the leading end portion, of between about 0.31 of an inch and about 0.53 of an inch and forming the diagonal dimension of the trailing end portion of between 0.37 of an inch and 0.59 of an inch.

21. The method according to claim 1, further comprising the step of manufacturing the compressed charge to have one of a generally cubic shape, a generally spherical shape, a generally conical shape, a generally cylindrical shape, a generally cylindrical shape provided with a trailing annular rim, and a generally cylindrical shape provided with an increase in diameter between the leading end and the trailing end of the compressed charge.

22. A method of manufacturing a premeasured compressed charge for use with an intended black powder firearm having barrel with a desired caliber, the compressed charge having a leading end portion with a smaller dimension than both a trailing end portion and the desired caliber of the intended firearm, and the trailing end portion having a smaller diagonal dimension than the desired caliber of the firearm such that both the leading end portion and the trailing end portion of the compressed charge are both received within the barrel of the firearm, the method comprising the steps of:

providing a mold having at least one cavity therein, and each cavity having a pair of opposed side walls which taper toward one another from a trailing end wall of the cavity toward the leading end wall of the cavity and a bottom molding surface of the cavity which extends normal to each of the opposed side walls and the two end walls;

filling the cavity of the mold with gunpowder having a sufficient moisture content;

pressing gunpowder contained within the cavity with a top molding surface, which extends parallel to the bottom molding surface, such that the gunpowder within the cavity is sandwiched between the parallel top and bottom molding surfaces and form the compressed charge and, as a result of such pressing, the formed compressed charge only tapers along two surfaces and one of a density and a compaction of the gunpowder, adjacent the leading end portion of the compressed charge, is about 0% to about 5% less than one of the density and the compaction of the gunpowder adjacent the trailing end portion to facilitate a more complete combustion of the compressed charge upon discharge of the firearm; and releasing the compressed charge from the cavity of the mold.

23. The method according to claim 22, further comprising the step of manufacturing the compressed charge from gunpowder having a particle size ranging of between about 1 micron and about 1000 microns.

24. The method according to claim 22, further comprising the step of adding between about 1% and about 10% by weight of moisture to the gunpowder before manufacturing the compressed charge therefrom.

25. The method according to claim 24, further comprising the step of using gunpowder formed from a mixture comprising:

10-35% by weight of potassium perchlorate;

25-60% by weight of potassium nitrate;

25-50% by weight of a fuel component; and 0-5% by weight of one of charcoal and carbon (lamp) black to manufacture the compressed charge.

26. The method according to claim 25, further comprising the step of selecting the fuel component from a group comprising at least one of the following: amino acid, ascorbic acid, sugar, starch, and carbon.

27. The method according to claim 22, further comprising the step of manufacturing the compressed charge to have one of a generally cubic shape, a generally spherical shape, a generally conical shape, a generally cylindrical shape, a generally cylindrical shape provided with a trailing annular rim, and a generally cylindrical shape provided with an increase in diameter between the leading end and the trailing end of the compressed charge.

* * * * *